US011326595B2

(12) United States Patent
Overmeier

(10) Patent No.: US 11,326,595 B2
(45) Date of Patent: May 10, 2022

(54) ECCENTRIC SCREW COMPRESSOR WITH EXPOSABLE ROTOR CONNECTOR

(71) Applicant: SEEPEX GmbH, Bottrop (DE)

(72) Inventor: Dirk Overmeier, Oberhausen (DE)

(73) Assignee: SEEPEX GMBH, Bottrop (DE)

( * ) Notice: Subject to any disclaimer, the term of this patent is extended or adjusted under 35 U.S.C. 154(b) by 319 days.

(21) Appl. No.: 16/343,692

(22) PCT Filed: Nov. 9, 2017

(86) PCT No.: PCT/EP2017/078808
§ 371 (c)(1),
(2) Date: Apr. 24, 2019

(87) PCT Pub. No.: WO2018/087254
PCT Pub. Date: May 17, 2018

(65) Prior Publication Data

US 2019/0257308 A1 Aug. 22, 2019

(30) Foreign Application Priority Data

Nov. 10, 2016 (DE) ..... 10 2016 121 581.3

(51) Int. Cl.
*F04C 2/107* (2006.01)

(52) U.S. Cl.
CPC ..... *F04C 2/1075* (2013.01); *F04C 2/1071* (2013.01); *F04C 2230/603* (2013.01); (Continued)

(58) Field of Classification Search
CPC ..... F04C 2/1075; F04C 2/1071; F04C 2230/603; F04C 2240/10; F04C 2240/20; (Continued)

(56) References Cited

U.S. PATENT DOCUMENTS 5,688,114 A * 11/1997 Millington ..... F04C 2/1071 418/182
5,769,618 A * 6/1998 Ono ..... F16C 1/02 418/48

(Continued)

FOREIGN PATENT DOCUMENTS

DE 102014117932 B 3/2016
DE 102015104300 A 9/2016
JP 070777172 B 3/1995

OTHER PUBLICATIONS

English Machine Translation of JP H07 77172A (Espacenet) (Year: 1995).*

*Primary Examiner* — Mary Davis
*Assistant Examiner* — Paul W Thiede
(74) *Attorney, Agent, or Firm* — Andrew Wilford

(57) ABSTRACT

An eccentric screw pump has a stator, a rotor in the stator, a drive for the rotor, and a pump housing between the stator and the drive and having an opening between for receiving the medium being pumped. A releasable drive-end coupling connects a connecting shaft of the drive to a coupling rod, and a rotor-end releasably connects the coupling rod to the rotor at a separation point. A rotor stub connects the rotor to the rotor-end coupling and is separable from the rotor at the separation point. A drive-end housing collar secures the pump housing to the drive. A rotor-end housing collar has a fixed first element fixed relative to the pump housing and an axially displaceable second element that is releasably fixable to the stator and that can be pushed axially toward the housing opening of the pump housing onto the first element to expose the separation point.

7 Claims, 3 Drawing Sheets

(52) U.S. Cl.
CPC ..... *F04C 2240/10* (2013.01); *F04C 2240/20* (2013.01); *F04C 2240/30* (2013.01); *F04C 2240/60* (2013.01)

(58) Field of Classification Search
CPC ..... F04C 2240/30; F04C 2240/60; F04C 15/0061; F04C 2/1073; F04C 2230/80; F04C 2230/85; F04C 2230/60; F04C 11/006; F16C 1/02
See application file for complete search history.

(56) References Cited

U.S. PATENT DOCUMENTS

| | | | | |
|---|---|---|---|---|
| 6,877,967 | B2 * | 4/2005 | Gantenhammer .... | F04C 2/1073 417/205 |
| 6,926,492 | B2 | 8/2005 | Hegebarth | |
| 9,777,728 | B2 | 10/2017 | Thomas | |

* cited by examiner

ECCENTRIC SCREW COMPRESSOR WITH EXPOSABLE ROTOR CONNECTOR

CROSS REFERENCE TO RELATED APPLICATIONS

This application is the US-national stage of PCT application PCT/EP2017/078808 filed 9 Nov. 2017 and claiming the priority of German patent application 102016121581.3 itself filed 10 Nov. 2016.

FIELD OF THE INVENTION

The invention relates to an eccentric screw pump.

BACKGROUND OF THE INVENTION

A standard eccentric screw pump comprises:

a stator, a rotor rotating in the stator, a drive for the rotor, a pump housing (for example suction housing) connected to the stator and having at least one housing opening (for example an inlet opening) for the medium being pumped, a connecting shaft connected to the drive (for example drive shaft), and a coupling rod in the pump housing (separably) connected on the drive end to the connecting shaft via at least one releasable drive-end connector and (separably connected) to the rotor via at least one releasable rotor-end connector, the suction housing having a drive-end housing collar and a stator-end housing collar. The housing opening (for example inlet opening) is preferably between the drive-end housing collar and the stator-end housing collar, so that these two housing collars flank the inlet or housing opening.

Such an eccentric screw pump is a pump from the group of rotary displacement pumps that are used to convey a wide variety of media and, in particular, liquid media and also highly viscous liquids in various industrial sectors. The liquids to be conveyed can also for example contain solid components. The pump is preferably used in mining, mine workings, tunnel construction, or the like.

The stator is made for example of elastic material and is usually surrounded by a one-part or multipart stator casing or housing (made for example of metal). The elastomeric stator can be securely connected to the stator casing, for example vulcanized therein. However, the invention also includes embodiments in which the stator is releasably and thus exchangeably formed by the stator casing. Alternatively, however, stators made of other material, such as metal, for example, are also included. This pump housing is also referred to in practice as a "suction housing." A housing part is generally provided on the end of the stator facing away from the suction housing referred to as a connector, for example a pressure port, so that the pressure port can be connected to the stator on the pressure side, for example. In principle, it is also possible to operate such a pump in the opposite direction of conveyance, in which case the pump housing (suction housing) would then be on the pressure side and the connector (pressure port) would then be on the suction side.

The rotating connection between the drive or the connecting shaft on the one hand and the rotor on the other hand, which simultaneously allows eccentricity, is achieved by the coupling rod in the pump housing. The drive acts on the coupling rod via the connecting shaft. The connecting shaft can be formed directly from the drive shaft of the drive.

Preferably, however, the connecting shaft is a shaft separate from the drive and that can be a plug-in shaft and serves, as it were, as a connecting piece between the drive shaft and the force transmission parts of the pump. A connecting housing can hold the connecting shaft between the pump housing (for example suction housing) and the drive. Such a connecting housing is also referred to in practice as a "bonnet." This is used to "receive" and/or fasten and support the pump housing on the one hand and the drive on the other hand, so that this connecting housing or bonnet is mounted on a base plate or directly on a foundation and supports and/or carries the drive and the pump housing. The drive can be electromotive or hydraulic.

The maintenance and repair of a pump is of particular practical importance, especially since various parts may be subject to substantial wear and, as wearing parts, may therefore need to be exchanged and replaced. The exchanging of the stator and, optionally, of the rotor is of particular importance, for instance. Since the rotor is generally connected to the coupling rod by a rotor-end coupling (for example pin or cardan coupling), it is necessary to disassemble this coupling for an exchange, so that the accessibility of the rotor-end coupling is of particular importance. Alternatively, however, additional separation points besides the coupling are known from practice, which must also be accessible for the purpose of rotor replacement.

Against this background, WO 2010/012993 [U.S. Pat. No. 9,777,728] has already described the possibility of exposing the region of the rotor-end coupling of the coupling rod where the stator-end or rotor-end housing collar of the pump housing is constructed so as to be removable. For this purpose, an element of this housing collar of the pump housing is releasable and can be pushed axially of the stator so that the rotor-end portion of the coupling rod is exposed. Alternatively, a housing part can also be formed from half-shells that are separable to expose a coupling region.

OBJECT OF THE INVENTION

Starting from the previously known art, it is the object of the invention to provide an eccentric screw pump of the above-described type characterized by simple construction and optimized possibilities for maintenance and repair.

SUMMARY OF THE INVENTION

To achieve this object, in a generic eccentric screw pump of the above-described type, the invention teaches that the rotor-end housing collar has a fixed first element and a displaceable second element that can be pushed axially toward the housing opening of the suction housing onto the first element to expose (and separate) the rotor-end connector.

The invention proceeds in this regard from the discovery that possibilities for the maintenance and repair of an eccentric screw pump of the type described can be optimized if the disassembly or dismantling of the pump housing is made simple and easy, so that a corresponding connector (for example a coupling) can be exposed in the drive train. According to the invention, a displaceable (second element) of the pump housing is provided for this purpose telescoped not onto the stator like in the prior art but rather in the opposite direction onto the pump housing itself and hence onto the first, fixed element of the pump housing. After appropriate separation of the drive train in this rotor-end connector, for example after separation of the rotor-end coupling, the stator and/or the rotor can be removed and replaced if necessary without having to remove or further dismantle the pump housing or suction housing itself. Such a rotor and/or stator replacement is thus not impeded by the displaceable housing part. In addition, this embodiment has the advantage that modular construction of the pump is optimized, because the design or dimensioning of the rotor/stator can be independent of the design or dimensioning of the pump housing, since no part of the pump housing must be pushed onto the rotor/stator, but rather the displaceable element is pushed up onto the fixed part of the pump housing toward the center of the pump housing and consequently toward the (central) housing opening of the pump housing.

The coupling rod can be connected to the rotor in a known manner by a rotor-end coupling. This means that the releasable connector that is made accessible as a result of the displacement of the connector is formed by this separable rotor-end coupling. In addition, however, a separation point can also be provided (in the rotor or in the coupling rod) in addition to the rotor-end coupling, so that the drive train can be separated independently of the rotor-end coupling. When viewed from the (central) coupling rod, this separation point is located the other side of the coupling. Such an additional separation point has the advantage that it enables a wear part, such as for example the rotor, to be replaced without detaching/separating the coupling. In this case, it is advantageous if this separation point can be exposed by moving the second displaceable element.

Optionally or in addition, the described configuration of the rotor-end housing collar can also be implemented in the region of the drive-end housing collar. The invention therefore also relates to a generic eccentric screw pump in which the drive-end housing collar has a fixed first element and a displaceable second element that can be pushed axially toward the housing opening of the pump housing onto the first element to expose the drive-end connector. The advantages described in connection with the rotor-end housing collar can thus also be achieved alternatively or additionally in the region of the drive-end housing collar, so that, in particular, a coupling provided on the drive end that interconnects the connecting shaft and the coupling rod can be exposed. In this way, the coupling rod can be separated from the connecting shaft or drive shaft, thus enabling the connecting shaft (for example plug-in shaft) in particular to be replaced, particularly without disassembling the suction housing or the drive as a whole. Instead, a locally very limited disassembly or opening of the pump housing in the region of the drive-end connector of the suction housing is sufficient. On the drive end as well, the possibility exists for the releasable connector to not have or not only have the disassemblable drive-end coupling, but rather, in addition to the coupling, a separation point that enables the coupling rod to be separated from the connecting/drive shaft without disassembly of the drive-end coupling. Such a separating point can also be exposed very easily according to the invention by the displaceable second element.

Optionally, the configurations of the drive-end housing collar on the one hand and of the rotor-end housing collar on the other hand can also be combined with one another. However, the invention also includes embodiments in which only the rotor-end housing collar or only the drive-end housing collar has the displaceable element.

Emphasis is placed on the exposure of a rotor-end and/or a drive-end connector. This can be the respective coupling (for example pin coupling, cardan coupling, or the like) itself, for example. As described, however, alternative or additional separation points can also be provided. For instance, preferably the rotor is connected to the coupling rod or to the rotor-end coupling with interposition of a rotor stub that can be separated from the rotor. Such an additional separation point in the vicinity of the rotor has the advantage that the rotor-end coupling itself does not have to be disassembled to replace the rotor and/or the stator. Instead, separation can take place at this additional separation point inside the rotor. The rotor itself is thus extended by an additional, separate rotor stub, in which case it is then possible for this rotor stub to particularly contain one half of the hinge of the rotor-end coupling, so that the rotor stub can be connected with its half of the coupling to the coupling rod with the other half of the hinge to form the rotor-end coupling. No separation of this coupling is required during the replacement of the rotor, however; instead, separation takes place inside the rotor between the rotor and the rotor region and the rotor stub, as it were. In the assembled state, the rotor stub can extend through the second element into the vicinity of the first element. The rotor-end coupling is preferably inside the fixed first element. Consequently, the stub extends the rotor and thus bridges the displaceable second element.

Especially preferably, the rotor is connected to the rotor stub via a removable spacer, for example a removable spacer ring. The spacer ring can consist of two or more ring segments, for example half-rings, that are distributed over the periphery. After the connection in the region of the separation point between the rotor stub and the rotor has been opened up, such a spacer can then be removed, thereby creating space (for disassembly) axially. In this way, the rotor or the rotor/stator combination can then be displaced axially toward the drive end and the rotor and/or stator can be replaced.

The (rotationally fixed) connection between the rotor stub and rotor can be done by screws, and the spacer can also be additionally provided. However, it also lies within the scope of the invention to create the rotationally fixed connection by the spacer. As an alternative to a screw connection, pin connections, half-ring connections, or the like are also possible.

The described additional rotor stub having a certain length also has the advantage that it can be used on existing pump housings and existing coupling rods. The fixed first element is then part of the existing pump housing, and the displaceable second element is mounted as an additional housing part. The rotor is extended by the additional rotor stub, as it were, so that the region of the additional displaceable element is bridged. A modular design and modular use of the housing parts is thus made possible.

Overall, it is possible within the scope of the invention to expose corresponding connectors in the drive train. Starting from the drive, the drive train consists of the drive shaft, optionally an additional separation point, the drive-end coupling, the coupling rod, the rotor-end coupling, the rotor stub, optionally an additional separation point and, finally, the rotor. The connector thus each comprise at least the coupling and optionally an additional separation point, with the additional separation point being provided starting from the (central) coupling rod either at the coupling or beyond the coupling. Thus, when the rotor/stator or the drive shaft or the mechanical seal are being replaced, the entire coupling rod together with the couplings remain in position. This shortens maintenance times compared to a variant in which the couplings themselves have to be dismantled.

Preferably the (tubular) second element and the (tubular) first element are each at least partially cylindrical or substantially cylindrical. It is advantageous if the inner diameter of the displaceable second element is greater (at least in some areas) than the outer diameter of the fixed first element. In the assembled state, a suitable seal is of course provided between the first element and the second element, so that the pump housing (for example suction housing) is liquid-tight and pressure-tight as a whole. At least one seal is provided for this purpose. For instance, the fixed first element can be provided on its outer surface with an annular seal, for example an O-ring. Alternatively or in addition, the displaceable second element can be provided on its inner periphery with a continuous seal, for example an O-ring. As will readily be understood, the oppositely situated part optionally has corresponding sealing surfaces against which the seal rests.

Moreover, the displaceable element is (releasably) secured with suitable fasteners, for example mounting screws, to the first (fixed) element. During operation, a suitable fixation is thus provided between the two elements.

In a first embodiment, the displaceable second element consists essentially of one (tubular) part pushed onto the fixed element. In an alternative development, there is the possibility that the displaceable element itself is composed of multiple parts and consists of at least two telescopically displaceable sleeves. In the assembled state, the total length of the displaceable element is then distributed to the two telescoping sleeves and, in the course of disassembly, the sleeves can telescope over one another so that, all in all, only a shortened space and consequently a shortened fixed first element need be provided. This makes an especially compact design of the pump housing possible.

The (elastomeric) stator can be secured in an inherently known manner with tie rods (or tie rods) axially, for example between a first flange on one of the ends of the pump housing and a second flange on the opposite end of the pump housing, for example in the vicinity of the pressure port.

For this purpose, these flanges have notches and the tie rods pass through the notches in the flanges and tensioning can finally be performed using suitable tensioning means, for example nuts or the like on the ends of the tie rods. According to another aspect of the invention, the notches into which the tie rods are notches open radially outward as slots open at the outer edge of at least on one of the flanges, so that the tie rods in the vicinity of this flange can be removed radially outward. The tie rods can then be removed radially from the flange after the tensioning screws/tensioning nuts are loosened, thus in particular making a very space-saving construction of the tie rods possible.

Optionally, the (elastomeric) stator has over its entire length or substantially therealong constant wall thickness. The same can apply to the stator casing or stator housing. Under the same pressure conditions, such a stator with a uniform wall thickness has the advantage over conventional pipe stators that its length and weight are reduced, making it easier to service.

Furthermore, the rotor is hollow, for example tubular at least over a portion of its length, preferably over its entire length. This results in a weight reduction and thus also in easier maintenance.

The eccentric screw pump according to the invention can be preferably used in mining and/or underground. Extreme conditions can occur in such applications that place high demands on the serviceability of the pump. Maintenance work is often performed in a confined space. This means that the inventive compact and space-saving design and optimized possibilities for disassembly are associated with special advantages in this area of application. Typical maintenance work involves replacement of wearing parts, particularly of the rotor and stator, but also of the mechanical seal.

The invention relates not only to the described eccentric screw pump, but also to a rotor assembly for such an eccentric screw pump, with such a rotor assembly comprising the rotor and the rotor stub as well as, optionally, a spacer, for example the spacer ring. As a wearing and replacement part of such an eccentric screw pump, this rotor assembly is also protected separately. The specific configuration can be realized in the manner described.

Furthermore, the invention relates to a pump system, for example for drainage in mine workings, tunnel construction, or the like, comprising at least one eccentric screw pump of the type described and at least one tank, for example a drainage tank, to which the eccentric screw pump is connected. The pump is preferably connected to the outlet of such a drainage tank.

BRIEF DESCRIPTION OF THE DRAWING

The invention is explained below with reference to a drawing that shows two embodiments. In the drawing.

SPECIFIC DESCRIPTION OF THE INVENTION

Figure 1:
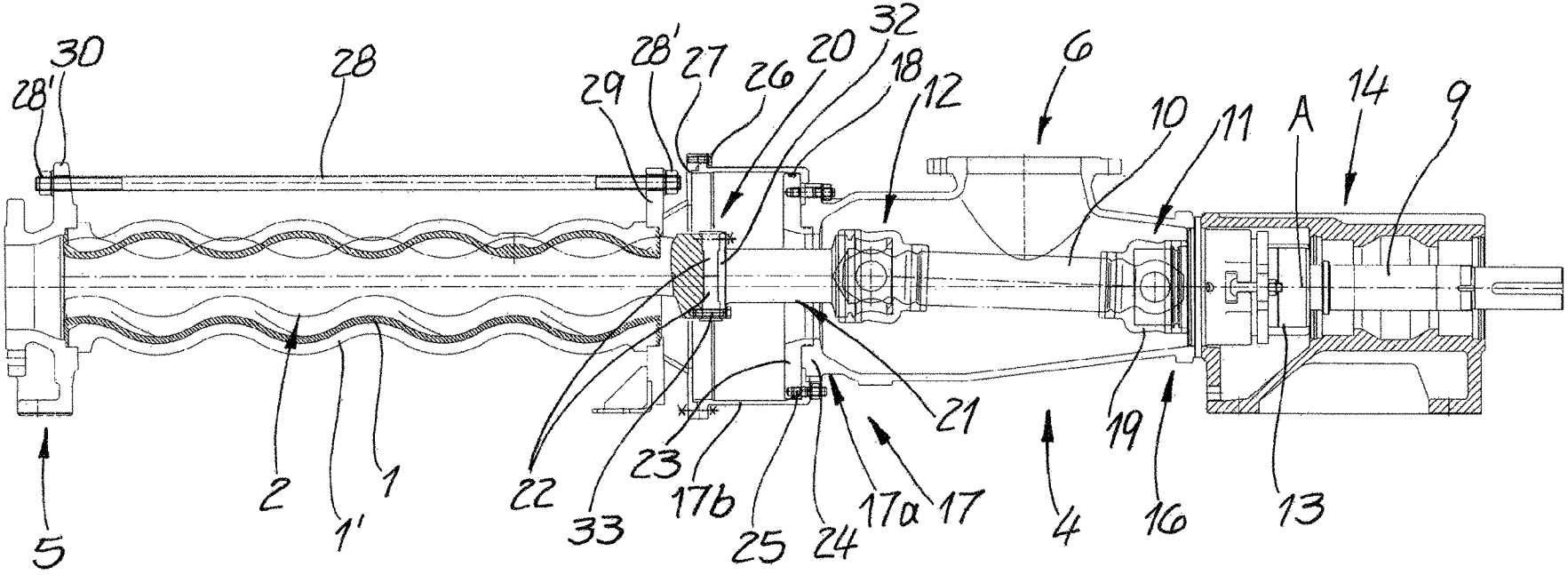
FIG. 1 is a (partial) vertical section through an eccentric screw pump according to the invention.

The drawing shows an eccentric screw pump that, in its basic construction, has a stator 1, a rotor 2 rotating in the stator 1 about an axis P, and a drive 3, 14 for the rotor 2. The eccentric screw pump has a (central) pump housing 4 also referred to as a suction housing. In this case, the pump housing 4 is connected at a suction end 7 to a suction end of the stator 1. On the opposite end of the pump housing 4, its drive end 8 is connected to the stator 1 as a connector also referred to as a pressure port 5. The pump housing 4 has a housing opening 6 used, for example, as an inlet opening for the medium being pumped, so that, depending on the operating direction, the medium is conveyed for example from the pump housing 4 via the stator/rotor to the pressure port 5. The drive 3, 14 is equipped with an integrated drive shaft (not shown) connected to a connecting shaft 9. In this embodiment, this connecting shaft 9 is a plug-in shaft. The rotor 2 is connected via a coupling rod 10 to the connecting shaft 9, the coupling rod 10 being connected via a drive-end coupling 11 to the connecting shaft 9 and via a rotor-end coupling 12 to the rotor 2. To seal the pump housing liquid-tight from the environment and/or against the drive, the connecting shaft 9 is surrounded by a shaft seal 13. This shaft seal 13 is for example a mechanical seal.

A connecting housing 14, also referred to as a bonnet, is between the pump housing 4 and is part of the drive 3, 14. Such a connecting housing 14 supports the pump housing 4 and the drive 3, 14. Accordingly, the connection housing 14 can be fastened to a base plate 15. The shaft seal 13 is connected to this connecting housing 14.

A drive end 8 of the pump housing 4 has a drive-end tubular housing collar 16 to which the connecting housing 14 is connected, with the drive-end coupling 11 being in this drive-end housing collar 16.

In addition, the pump housing 4 has a stator end 7 formed by a stator-end (tubular) housing collar 17 to which the stator 1 is connected, with the stator-end coupling or rotor-end coupling 12 being inside this stator-end housing collar 17.

In that case, the coupling rod 10 is separably connected by a releasable drive-end connector to the connecting shaft 9 and separably connected to the rotor 2 by a releasable rotor-end connector. On the drive end, this releasable connector is formed by the drive-end coupling 11.

The optionally separable rotor-end coupling 12 is provided on a rotor end of a separable rotor stub 21. In addition, however, a (further) separation point 20 is provided in addition to the coupling 12, so that the rotor 2 can be separated from the coupling rod 10 by separation at the separation point 20. In the illustrated embodiment, the rotor 2 is connected to the coupling rod 10 and to the coupling 12 with interposition of the separable rotor stub 21. The rotor stub 21 thus carries one half of the coupling 12 on its drive end. The rotor stub 21 is releasably connected to the rotor 2 on its opposite rotor end. This will be discussed further below.

In the embodiment illustrated in FIG. 1, the stator-end housing collar 17 has a fixed first element 17*a* on the one hand and a displaceable second element 17*b* on the other hand. The displaceable second element 17*b* can be slid axially toward the housing opening 6 of the pump housing 4 onto the first element 17*a* to expose (and separate) the rotor-end connector. The displaceable second element 17*b* is tubular and, in this embodiment, substantially cylindrical; it can be telescoped onto the fixed element 17*a*, thereby exposing the rotor-end connector, namely the separation point 20. The rotor and coupling rod can then be separated without disassembling the coupling 12 itself. The rotor and stator can be easily replaced after the housing part 17*b* has been pushed onto the housing part 17*a* and the separation point has been released.

In the illustrated embodiment, the separation point 20 is in effect integrated into the rotor 2, in that the rotor stub 21 is releasably connected at one end to the rotor 2, thus forming the separation point 20. The rotor stub 21 has a fixed length, so that it acts as an extension of the rotor 2 and thus also bridges the displaceable element 17*b*. In any case, the coupling 12 is inside the fixed element 17*a*. Consequently, the rotor stub 21 extends through the first element 17*a* and into the second element 17*b*. For that purpose, the rotor stub 21 carries one half of the coupling 12. The other half of the coupling is part of the coupling rod 10. The rotor stub 21 has a flange 32 at its end facing toward the rotor 2 and secured to the rotor 2 by screws 33. In this embodiment, it can be seen that this screwing is performed with interposition of a two-part spacer ring 22. This spacer ring 22, which can consist of two half-rings, can be removed after the screws 33 are loosened, so that a free space and thus an axially extending displacement gap for the rotor 2 is formed, thus facilitating disassembly. This will be discussed further below.

In addition, it can be seen that at least one seal ring 18 is provided between the first element 17*a* and the second element 17*b* that seals the first element 17*a* against the second element 17*b* in a liquid-tight and pressure-tight manner, particularly in the assembled state shown in FIG. 1. In this embodiment, the seal 18 is on the outer surface (for example in a groove) on the first element 17*a* or on an adapter piece 23 connected thereto. In fact, FIG. 1 shows that the adapter piece 23 has a flange 24 at the end and is connected to the fixed first element 17*a*. This adapter piece 23 carries the seal 18. The displaceable connecting part 17*b* is attached to this adapter piece 23 by mounting screws 25, i.e. it is connected by the adapter piece 23 with the mounting screws 25 to the flange 24.

Alternatively or in addition, the displaceable connecting part 17*b* is fastened on the rotor end by mounting screws 26 to a stator-end flange 29 or adapter piece 27.

In this respect, FIG. 1 shows that in the illustrated eccentric screw pump a suction housing known from the prior art can be used that already has the fixed element 17*a*, and the displaceable element 17*b* is provided as an additional component, so to speak, to form the suction housing 4 according to the invention 4.

Moreover, it can be seen that the stator 1 is secured by tie axially extending rods 28 between a first flange 29 and a second flange 30. The first flange 29 is on the end toward of the pump housing 4. The second flange 30 is on the opposite end of the pump housing 4 of the stator. It is part of the connector or pressure port 5. The flanges 29, 30 have notches 31 through which the tie rods 28 are passed. According to the invention, these notches 31 are notches that are open radially outward, for example slots, at least in the vicinity of one of the flanges, so that the tie rods 28 can be removed radially outward in the vicinity of this flange. The tie rods 28 can be fixed and/or tensioned with respective nuts 28'.

Figure 2:
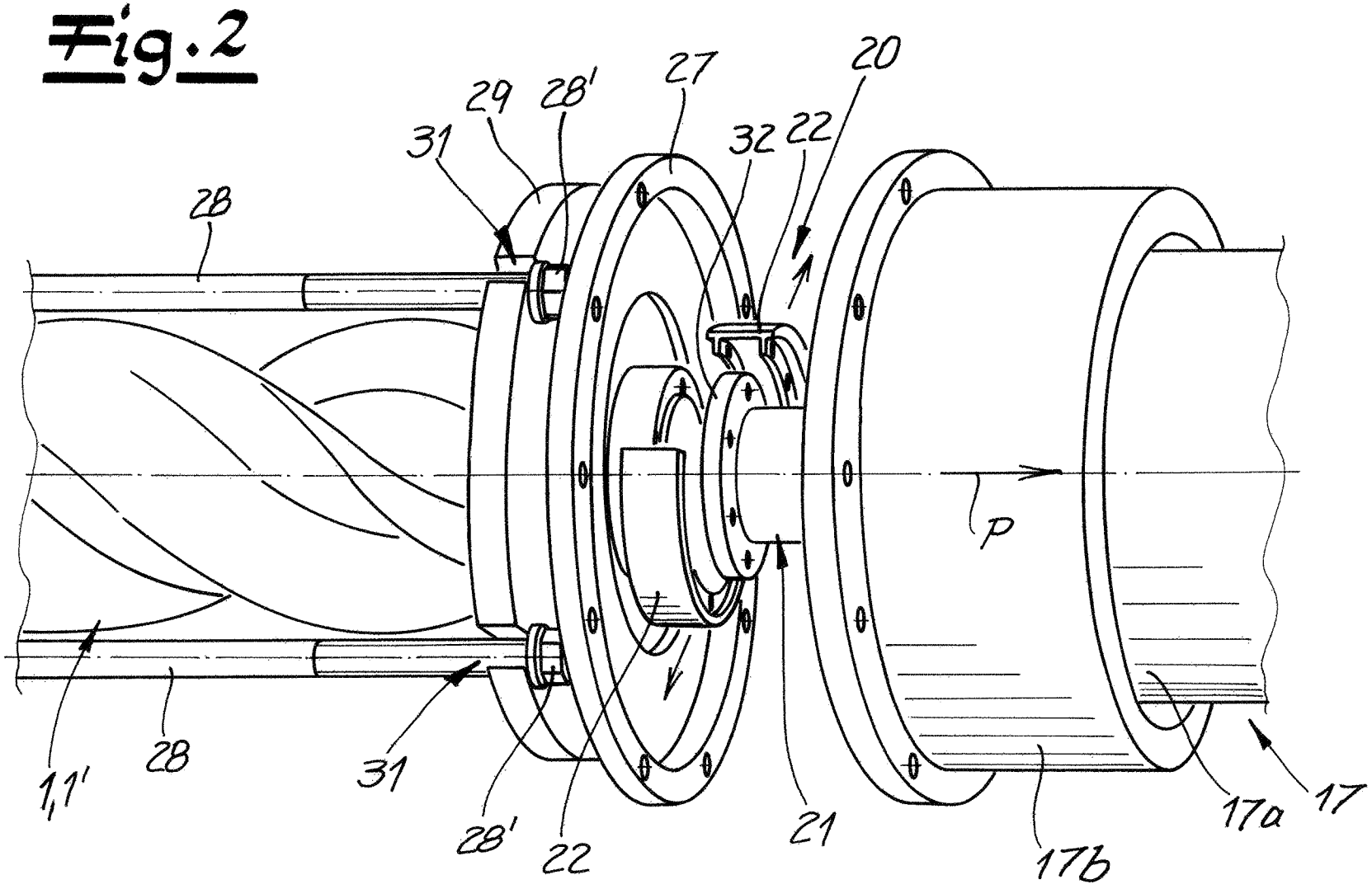
FIG. 2 is a large-scale detail from FIG. 1 showing a rotor-end coupling exposed.

In the illustrated embodiment, the rotor and/or stator is disassembled as follows:

First, the mounting screws 25 and 26 of the displaceable element 17*b* are withdrawn so that the displaceable element 17*b* can then be pushed in the direction of arrow P onto the first element 17*a*. As a result, the region of the separation point 20 is exposed. The screws 33 can then be unscrewed and the spacer ring 22 removed (see FIG. 2). This creates the above-described axial clearance between the rotor 2 and the rotor stub 21 separated therefrom. Now the tie rods 28 can be loosened and removed. Meanwhile or subsequently, it is possible to displace the adapter piece 27 with the attached flange 29 axially as shown by the arrow P. By virtue of the free space now gained, rotor 2 and stator 1 can also be displaced toward the arrow P and removed. All in all, it is possible to replace rotor and/or stator without dismantling the coupling 12 and, in particular, without disassembly of the pressure port 5 and suction housing 4.

Moreover, it can be seen that, in the illustrated embodiment, the elastomeric stator 1 has a substantially constant wall thickness over its entire length or over substantially its entire length. The same applies to the illustrated stator casing 1' (made of metal). In this embodiment, the stator 1 is securely connected to the casing 1', for example vulcanized therein.

The illustrated pump can be part of a pump system and/or of a drainage system that can be used in mining, for example, in which case such a pump system comprises at least the depicted pump and an unillustrated drainage tank.

Particular importance is attached to the rotor assembly that can consist of the rotor 2 with the rotor stub 21 and the spacer ring 22.

Figure 3:
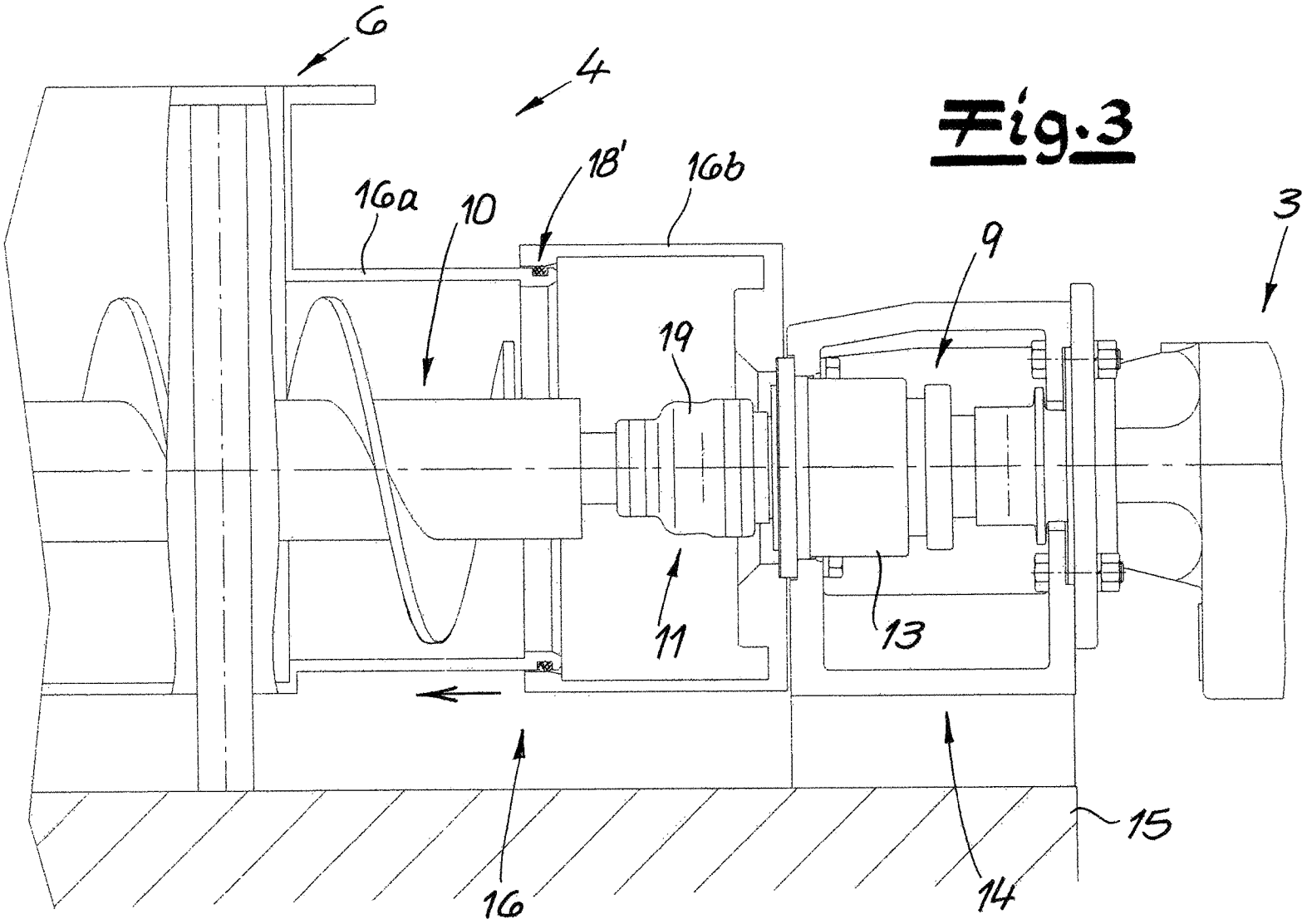
FIG. 3 is a large-scale detail from a modified embodiment of the pump according to FIG. 1.

A second embodiment of the invention is partially illustrated in FIG. 3. This second aspect of the invention relates to the drive end of the pump housing. The drive-end housing collar 16 consists here of a first, fixed element 16*a* and a second, displaceable element 16*b*. In the illustrated embodiment, the second element 16*b* is axially displaceable. Axial displacement of the second element 16*b* exposes the region of the drive-end coupling 11 and thus makes it accessible. Displacement of the second element 16*b* takes place axially toward the first element 16*a* and hence toward the inlet opening 6 of the pump housing 4.

At least one seal 18' is provided between the first element 16*a* and the second element 16*b*. After the second element 16*b* is pushed onto the first element 16*a*, then the sleeve 19 of the drive-end coupling 11 can be removed and the coupling disassembled. The coupling rod 10 can then be displaced and/or pulled out together with the attached rotor 2 away from the drive end 2. It is also possible to disassemble and/or replace the connecting shaft and/or the mechanical seal.

The invention claimed is:

1. An eccentric screw pump comprising:

a stator defining an axis;

a rotor extending along the axis and rotating in the stator;

a drive for rotating the rotor;

a pump housing having a stator end connected to the stator, a drive end connected to the drive, and a housing opening between the stator end and the drive end for receiving the medium being pumped;

a connecting shaft connected to the drive;

a coupling rod in the pump housing;

a releasable drive-end coupling at the drive end of the pump housing and connecting the connecting shaft to the coupling rod;

a rotor stub rotationally connected to the rotor and extending axially toward the coupling rod;

a rotor-end coupling at the stator end of the pump housing and releasably connecting the coupling rod at a separation point to the rotor stub;

a spacer ring between the rotor and the rotor stub;

a drive-end housing collar securing the pump housing to the drive; and a rotor-end housing collar having a fixed first element fixed relative to the pump housing and an axially displaceable second element that is releasably fixable to the stator and that when pushed axially toward the housing opening of the pump housing onto the fixed first element exposes the separation point, the rotor stub extending through the displaceable second element into the fixed first element.

2. The eccentric screw pump according to claim 1, wherein the displaceable second element is tubular and substantially cylindrical and telescopes axially with the fixed first element.

3. The eccentric screw pump according to claim 1, further comprising:

fasteners securing the displaceable second element to the fixed first element.

4. The eccentric screw pump according to claim 1, wherein the fixed first element and the second displaceable element are formed by first and second telescopically displaceable sleeves.

5. The eccentric screw pump according to claim 1, further comprising:

tie rods reinforcing the stator axially and extending between a first flange and a second flange axially flanking the stator and fitted in notches open at outer edges of the flanges so that the tie rods can be removed radially outward from the notches in the vicinity of the flanges.

6. The eccentric screw pump according to claim 1, wherein the stator has a substantially constant wall thickness over substantially all of its entire axial length.

7. The eccentric screw pump according to claim 1, wherein the rotor is tubular over at least a portion of its length.

* * * * *